US006256816B1

(12) United States Patent
Law

(10) Patent No.: US 6,256,816 B1
(45) Date of Patent: Jul. 10, 2001

(54) METHOD OF FORMING A TEXTILE ARTICLE

(75) Inventor: John Richard Dudley Law, Alderley Edge (GB)

(73) Assignee: Richard Hudson and Sons Limited, Burnley (GB)

( * ) Notice: Subject to any disclaimer, the term of this patent is extended or adjusted under 35 U.S.C. 154(b) by 0 days.

(21) Appl. No.: 08/981,060

(22) PCT Filed: Jun. 10, 1996

(86) PCT No.: PCT/GB96/01343

§ 371 Date: Feb. 26, 1998

§ 102(e) Date: Feb. 26, 1998

(87) PCT Pub. No.: WO96/41560

PCT Pub. Date: Dec. 27, 1996

(30) Foreign Application Priority Data

Jun. 10, 1995 (GB) ..... 9511816

(51) Int. Cl.[7] ..... A47C 27/00

(52) U.S. Cl. ..... 5/482; 5/699; 5/490; 5/932

(58) Field of Search ..... 5/482, 490, 699, 5/932, 948, 952, 939; 53/524

(56) References Cited

U.S. PATENT DOCUMENTS 5,050,256 * 9/1991 Woodcock ..... 5/939 X
5,321,861 * 6/1994 Dancey et al. ..... 5/939 X

FOREIGN PATENT DOCUMENTS

667196 * 9/1988 (CH) ..... 5/699
2737756 3/1979 (DE) .
0352802A3 1/1990 (EP) .
2 262 034 6/1993 (GB) .
1002184 5/1996 (NL) .
WO 91/19443 12/1991 (WO) .
WO 93/14929 8/1993 (WO) .

* cited by examiner

*Primary Examiner*—Michael F. Trettel
(74) *Attorney, Agent, or Firm*—Towsend and Towsend and Crew LLP

(57) ABSTRACT

A method of forming a textile article and the resultant article has contained filling preventing penetration by allergens. A continuous rectilinear strip of air permeable material has parallel side edges and terminates at an edge transverse to the parallel side edges at substantial right angles to the parallel side edges. This continuous rectilinear strip of air permeable material is non-permeable to allergens. The continuous rectilinear strip of air permeable material is folded back upon itself at a fold such that at least the parallel side edges overlie one another and the edge transverse to the parallel side edges spans the continuous rectilinear strip of air permeable material between the parallel side edges. The continuous rectilinear strip underlying the edge transverse to the parallel side edges of air permeable material is cut to form the textile article having a fold and three pairs of overlying edges. Welding occurs along at least two of the three pairs of overlying edges one to another along welds to form the textile article closed on one side at the fold, closed on two sides at the welds, and having an opening between two overlying sides. Filling material is introduced into the textile article at the opening followed by welding of the opening closed. A textile article is formed with three welded sides and a fold for allergen free containment of the filling material therein.

9 Claims, 1 Drawing Sheet

METHOD OF FORMING A TEXTILE ARTICLE

This invention relates to a method of forming a textile article and more particularly to a method of forming a textile article comprising a cover which encloses a filling material. The invention also relates to a textile article made according to the method.

Conventionally when forming textile articles, especially those which have filling material with an external cover, it is usual for the material from which the article is to be made to be cut to size, folded or otherwise arranged whereby adjacent edges can be secured together by stitching to form a complete enclosure. Conventionally, if filling material is to be included in the enclosure, this is either introduced into the article prior to the securing of at least one of the edges or alternatively a zip fastener or other releasable fastener can be introduced into one edge of the article to allow the filling to be inserted after the edges have been secured together.

Whilst such methods are acceptable for the production of textile articles, the introduction of stitching or other means of securing the edges together can produce an article in which the edges are not adequately sealed insofar as the stitching or other means of securing may not be capable or preventing the passage of matter, for example allergens, through the edges into The body of the article. A particular problem of this kind exists if the passage of dust mite material through the edges is permitted as such material can give rise to allergic symptoms in some people.

It is an object of the present invention to overcome or at least minimise the problems associated with the aforementioned prior art arrangement.

Thus, and in accordance with a first aspect of the present invention therefore, there is provided a method of forming a textile article comprising the steps of:

- forming from an air permeable material a cover having top and bottom cover parts which overlie each other such that at least the edges thereof are adjacent each other;
- securing all but one, or at least a part thereof, of said edges together by welding;
- introducing a filling material into said article through said one edge, or said part thereof; and
- sealing said one edge, or part thereof, together by welding to form a textile article in which said sealed edges are not penetrable by allergens, With this method it is possible to produce in a simple and efficient manner textile articles which are sealed at edges thereof.

The present invention has arisen due to the long felt need for a textile article which is both sealed effectively to any allergens but which is nevertheless breathable insofar as it is air permeable to allow articles made using the method to expand or contract as pressure is applied to them Of course, whilst the material from which the article is made is required to be air permeable, it must be ensured that the pore size of the material is not such that unwanted allergens of a size down to 0.6 $\mu$m can pass through the material pores, Hitherto it has not been thought possible to provide an article of this type which is totally sealed around its edges since it was not believed possible to provide such an article which could be sufficiently air permeable whilst still providing a barrier to allergens.

Preferably the material is a thermoplastic material and preferably comprises a polyolefin. Most preferably the material is formed from polypropylene or polyethylene.

Preferably the material is permeable to both air and moisture.

Preferably sealing of the edges is carried out utilising a welding operation preferably using high frequency radiation, for example ultrasonic radiation. Alternatively any other suitable frequency of wave can be used as desired or as appropriate. Alternatively a secure adhesive can be used.

Thus, and in accordance with a second aspect of the present invention therefore, there is provided a textile article comprising a cover is formed from an air permeable material, said cover enclosing a filling material, wherein outer edges of said cover are sealed whereby the article is rendered impenetrable to allergens.

With such an article it will be appreciated that sealing of the edges provides a non-penetrable barrier to the passage of allergens, whilst the air permeable nature of the material allows the sealing to be undertaken without the article being prone to "bursting" if pressure is applied.

The second aspect of the invention may include some or all of the features of the first aspect of the invention.

Preferably the material has a pore size of between 1–1.5 $\mu$m.

The invention will now be described with reference to the accompanying drawings of which:

Figure 1:
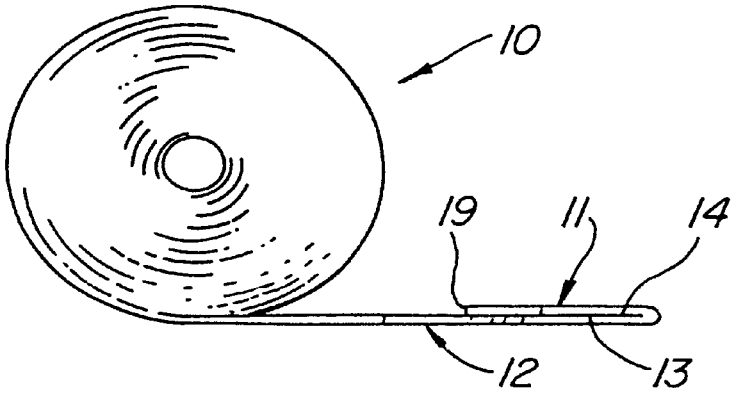
FIG. 1 shows a schematic side view illustrating a part of one form of method according to the present invention.
Figure 2:
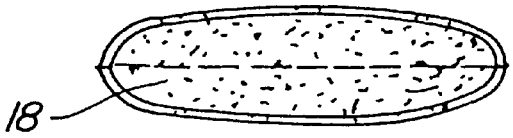
FIG. 2 shows a schematic end view of an article at one stage of the method of the present invention.
Figure 3:
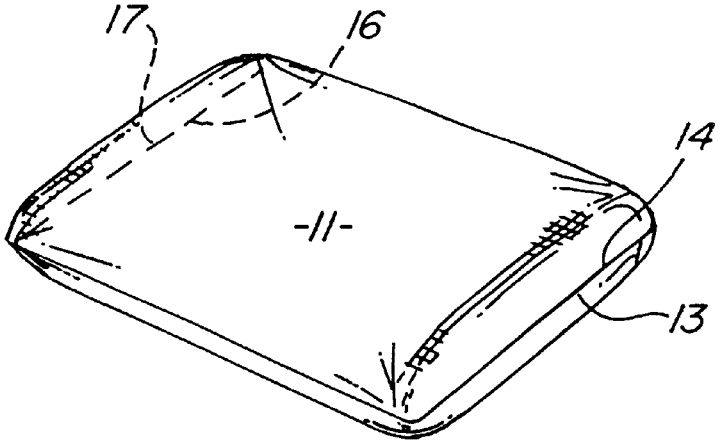
FIG. 3 shows a diagrammatic perspective view of a textile article produced in accordance with the method of the present invention.

Referring now to the figures, there is shown in FIG. 1 a continuous roll 10 of a thermoplastics material, preferably polypropylene, from which a length of material has been drawn. A free end 11 of the length of material is folded back upon itself so as to overlie a remaining part 12 of the length of material. Alternatively the length of material can be cut from the roll 10 and further cut into two pieces, which can then be placed so as to overlie each other with edges adjacent. Adjacent side edges 13, 14 and 16, 17 of the free end and the remaining part of the length of material, or the adjacent edges of the material pieces, are welded together by ultrasonic welding such that the edges are secured together to form a cover in the form of bag which is open at one end. A filling material 18 of any suitable form is then introduced into the cover through the open end, then, as shown in FIG. 2, the open end of the cover is sealed by welding. The sealing of the open end of the bag can cause severing of the material from the continuous roll in the case where the cover is formed whilst the material is attached to the roll 10. The textile article thus formed is sealed at all four edges thereof. Such a textile article is shown in FIG. 3. The article thus formed is constructed from an air permeable material and is sealed on all sides. The material is also impermeable to allergens and has a pore size of between 1–1.5 $\mu$m. Such a pore size will in particular prevent the ingress of the most problematic allergens, i.e. dust mite allergens, whilst still permitting expansion and contraction of the pillow upon pressure being applied. Furthermore, the sealed edges of the article provide an absolute barrier to the penetration of any matter through them. The article produced in accordance with the present invention has considerable advantages over prior art articles of this type due to its air permeability and sealed edges. By way of explanation of these advantages, comparative experiments were carried out on prior art articles of this kind and an article of the kind with which the present invention is concerned and these are detailed below by way of example only.

EXAMPLE 1

An article was made using a non-air permeable material (when measured according to ERT 140.1–81), the material however being impermeable to allergens. The edges of The article were stitched except for one edge which was secured using a zip fastener. When the article was tested with particles of size range 1–1.5 μm (the typical size range of allergen particles), it was found that 66% of these particles penetrated the cover. This was found to be due to particles penetrating the edges of the article. It was also found that as the material was not air permeable, the pressure internally of the articles was approximately 180 Pa which is too high.

EXAMPLE 2

An articles was made using an air permeable material (50 $l/m^2/sec$ 10 when measured according to ERT 140.1–81), the material being less impermeable to the allergens to the fabric of Example 1 due to its air permeability. The edges of the article were stitched except for one edge which was secured using a zip fastener. When this article was tested with particles of size range 1–1.5 μm, it was found that 8.9% of the particles penetrated the cover. This was found to be due to particles penetrating the edges of the article, although it will be seen that the value is lower than the previous example. This reduction is believed to be due to the increasing air permeability of the material. It was found that, as the material is air permeable, the internal pressure of the article was approximately 7.8 Pa which is adequate.

EXAMPLE 3

An article was made using material which is air permeable (when measured according to BS 7209:1990) and which is impermeable to allergens, The edges of the article were sealed using welding When this article was tested with particles of size range 1–1.5 μm, it was found that less than 0.1% of particles penetrated the cover, whilst internal pressure was still an acceptable 7.8 Pa.

Thus it can be seen that considerable advantages are offered by the method and article of the present invention. Sealing of the edges of such an article renders the allergen penetration almost negligible whilst air permeability ensures that sealing can be undertaken whilst allowing compression and expansion of the article when a force is applied to take place. This allows internal pressure of air in the article to remain low.

Whilst in the embodiments described above sealing of the edges is carried out using welding, it is to be appreciated that sealing can be carried out in any suitable manner as desired or as appropriate. The only criterion of the sealing step is that the sealing operation must render the edges of the article impermeable to allergens. Thus, for example, heat sealing, epoxy resins or other forms of secure adhesives can be used.

Furthermore, whilst the present invention is concerned primarily with the production of a textile article which is impermeable to dust mite allergens, it is of course to be understood that such an article will also necessarily be impermeable to other forms of allergens and therefore other possible allergic reactions may be avoided.

It is of course to be understood that the invention is not intended to be restricted to the details of the above embodiment which are described by way of example only.

For example, whilst the term textile article used herein is intended to primarily describe such article as an item of furnishing or bedding such as pillows, duvets, quilts, etc., it is of course to be appreciated that the invention can be used in relation to a textile article of any other suitable form.

What is claimed is:

1. A method of forming a textile article consisting of the steps of:

providing air permeable and vapor permeable material having individual pores with a pore size in the range of 1 to 1.5 μm, non-penetrable by allergens, and air permeable to allow a sealed construction without the article being prone to bursting when pressure is applied;

forming from the air permeable and vapor permeable material a cover having top and bottom cover parts which overlie each other such that at least the edges thereof are adjacent each other;

securing all but one, or at least a part thereof, of said edges together non-releasably;

introducing a filling material into said article through said one edge, or said part thereof; and, non-releasably sealing said one edge, or part thereof, without breather elements for the release of interior pressure to form a textile article in which said sealed edges are not penetrable by allergens and the sealed construction is not prone to bursting when pressure is applied.

2. A method of forming a textile article according to claim 1 wherein the material is a thermoplastic material.

3. A method of forming a textile article according to claim 2 wherein the material is a polyolefin.

4. A method of forming a textile article according to claim 3 wherein the material is formed from polypropylene or polyethylene.

5. A method of forming a textile article according to claim 1 wherein sealing is carried out utilizing high frequency radiation.

6. A method of forming a textile article according to claim 1 wherein the sealing is carried out using a secure adhesive material.

7. A textile article consisting of:

a cover formed from air permeable material and vapor permeable material having top and bottom cover parts which overlie each other such that at least the edges thereof are adjacent each other; the air permeable material having individual pores with a pore size in the range of 1 to 1.5 μm;

filling material placed between the top and bottom cover parts; and, all of edges being non-releasably joined one to another whereby the filling material is captured between the top and bottom cover parts, is non-penetrable by allergens, and is air permeable to allow a sealed construction without the article beings prone to bursting when pressure is applied.

8. A textile article according to claim 7 wherein said permeable material comprises an air permeable non-woven textile material.

9. A textile article according to claim 7 wherein said sealed edges are welded using high frequency radiation.

* * * * *